US008568169B2

(12) United States Patent
Akiguchi et al.

(10) Patent No.: US 8,568,169 B2
(45) Date of Patent: Oct. 29, 2013

(54) WATERPROOF CONNECTOR AND METHOD OF ASSEMBLY OF WATERPROOF CONNECTOR

(75) Inventors: Tetsuro Akiguchi, Kanagawa (JP); Ryuichi Komiyama, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/328,297

(22) Filed: Dec. 16, 2011

(65) Prior Publication Data

US 2012/0156910 A1 Jun. 21, 2012

(30) Foreign Application Priority Data

Dec. 17, 2010 (JP) ..... 2010-281814

(51) Int. Cl.
*H01R 13/40* (2006.01)

(52) U.S. Cl.
USPC ..... 439/587; 439/589

(58) Field of Classification Search
USPC ..... 439/275, 276, 587–589
See application file for complete search history.

(56) References Cited

U.S. PATENT DOCUMENTS

| | | | | |
|---|---|---|---|---|
| 6,095,860 | A * | 8/2000 | Gehrke et al. | 439/587 |
| 6,872,092 | B2 * | 3/2005 | Oka | 439/587 |
| 7,114,991 | B2 * | 10/2006 | Shiga et al. | 439/587 |
| 7,156,698 | B2 * | 1/2007 | Yamashita | 439/587 |
| 7,744,411 | B2 * | 6/2010 | Casses et al. | 439/587 |
| 2003/0087551 | A1 | 5/2003 | Okayasu et al. | |
| 2006/0040553 | A1 | 2/2006 | Yamashita | |

FOREIGN PATENT DOCUMENTS

| | | |
|---|---|---|
| EP | 1592090 A1 | 2/2005 |
| JP | 3174261 | 3/2001 |

OTHER PUBLICATIONS

European Search Report, dated Mar. 14, 2012, 7 pages.

* cited by examiner

*Primary Examiner* — Thanh Tam Le
(74) *Attorney, Agent, or Firm* — Barley Snyder

(57) ABSTRACT

A water-proof connector has a inner housing, a wire seal, and an outer housing. The outer housing has a plurality of electrical wire insertion passageways and a plurality of first boss pins disposed along an outer periphery of a region in which electrical wire insertion passageways are formed. The plurality of first boss pins include tip end parts with a tapered surface only in a portion facing outward from the region in which the electrical wire insertion passageways are formed.

20 Claims, 7 Drawing Sheets

WATERPROOF CONNECTOR AND METHOD OF ASSEMBLY OF WATERPROOF CONNECTOR

CROSS-REFERENCE TO RELATED APPLICATIONS

This application claims the benefit of the filing date under 35 U.S.C. §119(a)-(d) of Japanese Patent Application No. 2010-281814, filed Dec. 17, 2010.

FIELD OF THE INVENTION

The invention relates to a connector and, in particular, to a water-proof connector and a method of assembling the water-proof connector.

BACKGROUND

A known water-proof connector is provided with a wire seal or a collective rubber stopper disposed in a connector housing in order to prevent entry of water or the like from the outside (see Japanese Patent No. 3174261, for example). The wire seal has a plurality of contact insertion passageways at positions corresponding to a plurality of cavities in the connector housing. When a contact is inserted into the cavity through the contact insertion passageway, the inner periphery of the contact insertion passageway comes into close contact with an electrical wire connected to the contact to provide waterproofness.

The connector housing typically includes an outer housing and an inner housing. With the water-proof connector, the inner housing is fitted into a recess positioned in the outer housing, and the wire seal is interposed between the outer housing and the inner housing.

Generally, the connector housing is made of a resin material, and the wire seal is made of a rubber-based material. In order to align the cavities formed in the outer housing and the inner housing and the contact insertion passageways formed in the wire seal with each other, the wire seal is secured in the inner housing and positioned with pins with respect to the outer housing. That is, pin-shaped bosses are formed on the outer housing, and recesses into which the bosses are inserted are formed in the wire seal fitted in the inner housing. The wire seal is positioned in the outer housing by inserting the bosses into the recesses of the wire seal. However, the aforementioned conventional techniques have problems, as described below.

During assembly of the water-proof connector, the wire seal to be fitted into the inner housing has a predetermined fastening margin in order to ensure sealability between the wire seal and the inner housing. Therefore, when the wire seal is fitted into the inner housing, the wire seal is inwardly compressed and deformed. The compression and deformation of the wire seal may result in a displacement of the recesses formed in the wire seal from the original positions. In this case, the bosses on the outer housing cannot be inserted into the recesses of the wire seal, and the assembly of the water-proof connector fails.

Even if the wire seal is not properly positioned in the recess of the outer housing, the outer housing and the inner housing may be forcedly fitted with each other, because the wire seal is made of a rubber-based material. However, in such a case, the contacts cannot be inserted into the contact insertion passageways in the wire seal or are bent, and the connector cannot carry out its function as a connector.

SUMMARY

The present invention has been devised in view of the technical problem described above, and an object of the present invention, inter alia, is to provide a water-proof connector that can be smoothly assembled and can properly carry out its function as a connector.

The connector includes an inner housing, a wire seal, and an outer housing. The outer housing has a plurality of electrical wire insertion passageways and a plurality of first boss pins disposed along an outer periphery of a region in which electrical wire insertion passageways are formed. The plurality of first boss pins include tip end parts with a tapered surface only in a portion facing outward from the region in which the electrical wire insertion passageways are formed.

BRIEF DESCRIPTION OF THE DRAWINGS

The invention will now be described in greater detail with reference to the accompanying figures of which.

DETAILED DESCRIPTION OF THE EMBODIMENT(S)

Figure 2:
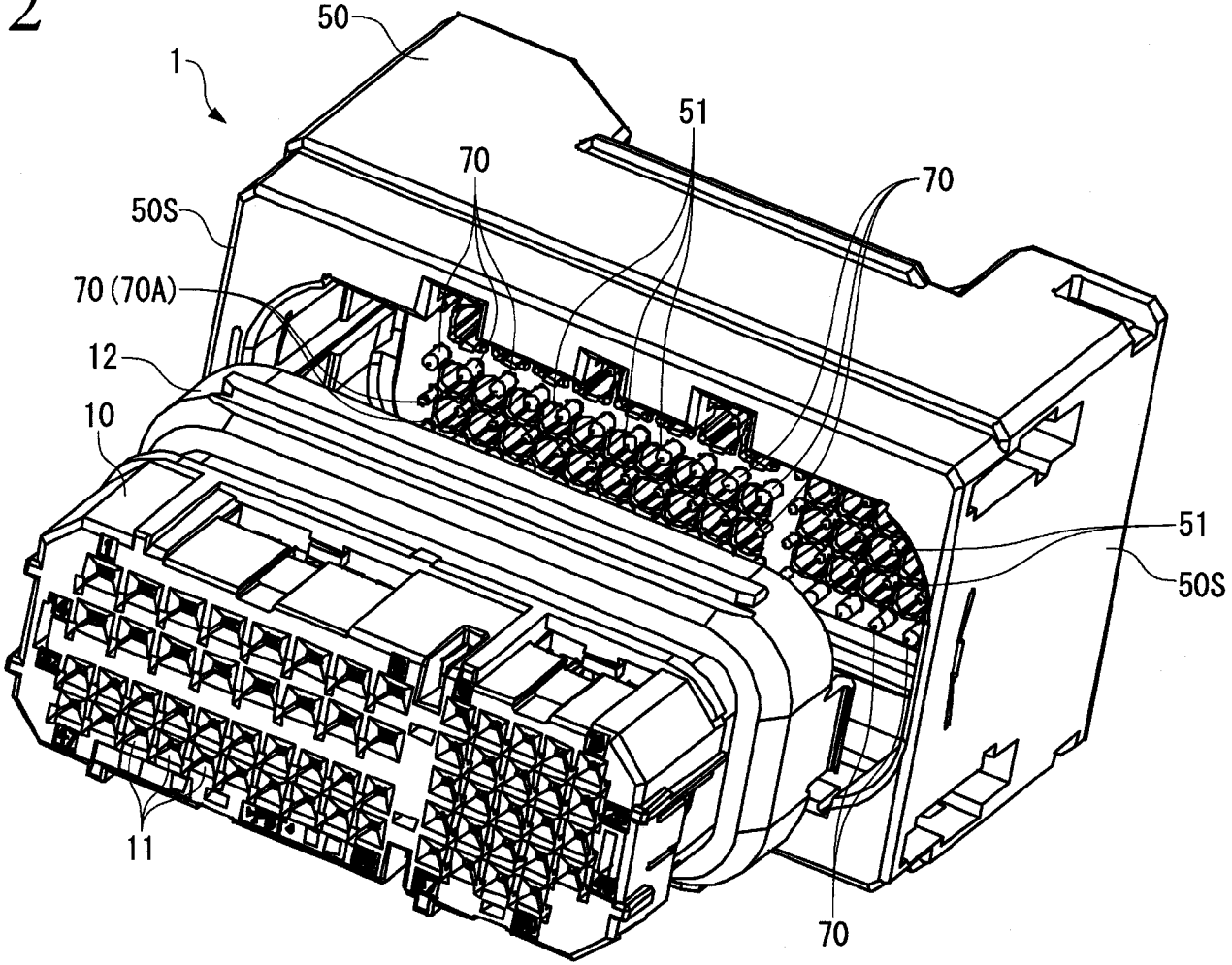
FIG. 2 is a rear exploded perspective view of the water-proof connector shown in FIG. 1.
Figure 3:
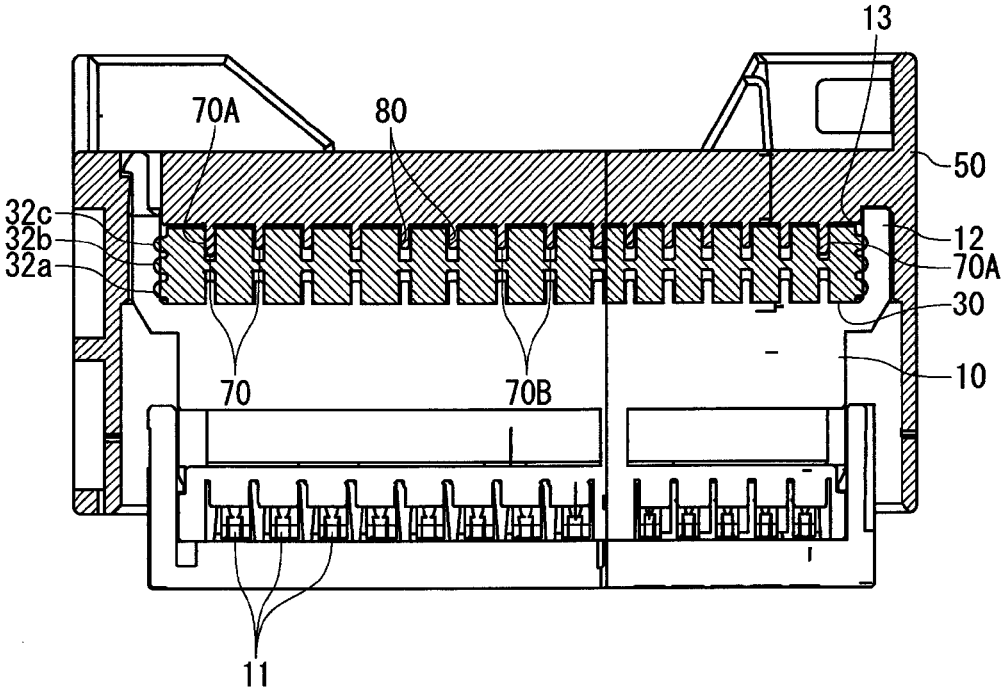
FIG. 3 is a cross-sectional view of the water-proof connector according to the invention.

The invention will now be described in greater detail with reference an embodiment shown in the drawings. A water-proof connector 1 shown in FIGS. 1 to 3 includes an inner housing 10, a wire seal 30, and an outer housing 50.

The inner housing 10 has a substantially rectangular shape. A plurality of contact receiving passageways 11 for accommodating contacts (not shown) are formed in the inner housing 10. Although not shown, each contact receiving passageway 11 penetrating the inner housing 10 in the front-rear direction has a housing lance for primarily holding the contact.

The inner housing 10 has a frontward extending peripheral wall 12 formed along the circumference of the front end of the inner housing 10 facing the outer housing 50. The interior of the peripheral wall 12 forms a seal housing recess 13 for housing the wire seal 30.

The wire seal 30, which is a collective water-proof member, has a substantially plate shape and is configured to be housed in the seal housing recess 13 of the inner housing 10. The wire seal 30 is typically made of an elastomer (an elastic polymer) but can be made of any material that provides waterproofness.

The outer shape and dimensions of the wire seal 30 are designed to ensure close contact with the inner peripheral surface of the peripheral wall 12. A plurality of ridges 32*a*, 32*b* and 32*c* for improving the contact with the inner peripheral surface of the peripheral wall 12 of the inner housing 10 are formed on the outer peripheral surface of the wire seal 30.

The wire seal 30 has a plurality of contact insertion passageways 31 at positions corresponding to the contact receiving passageways 11. Electrical wires connected to power contacts accommodated in the contact receiving passageways 11 are led to the side of the outer housing 50 through the contact insertion passageways 31.

Figure 4:
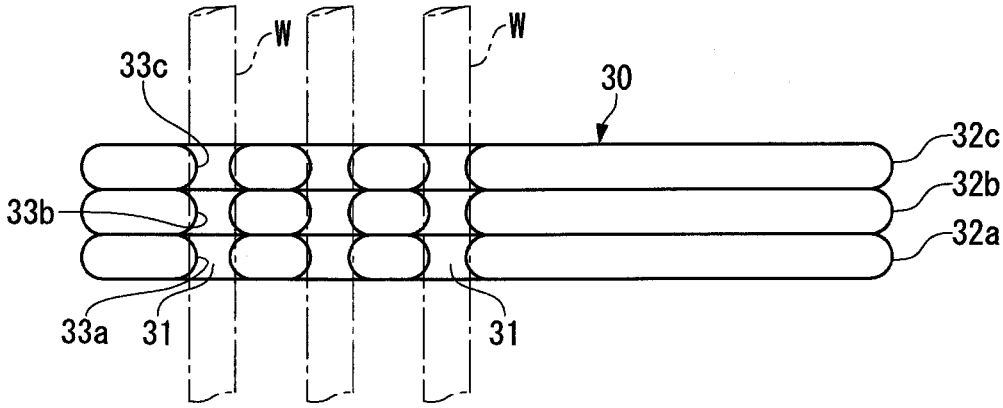
FIG. 4 is a cross-sectional view of a wire seal of the water-proof connector according to the invention.

As shown in FIG. 4, a plurality of ridges 33*a*, 33*b* and 33*c* are formed on the inner periphery of each contact insertion passageway 31, and the ridges 33*a*, 33*b* and 33*c* are in close contact with the outer peripheral surface of an electrical wire W. As a result, water can be prevented from entering the interior of the inner housing 10 through each contact insertion passageway 31.

The outer housing 50 is mounted to cover the inner housing 10 to prevent the wire seal 30 from dropping off.

The outer housing 50 has a plurality of electrical wire insertion passageways 51 at positions corresponding to the contact receiving passageways 11. The electrical wires W to be connected to the contacts are led to the rear side through the electrical wire insertion passageways 51.

Figure 5:
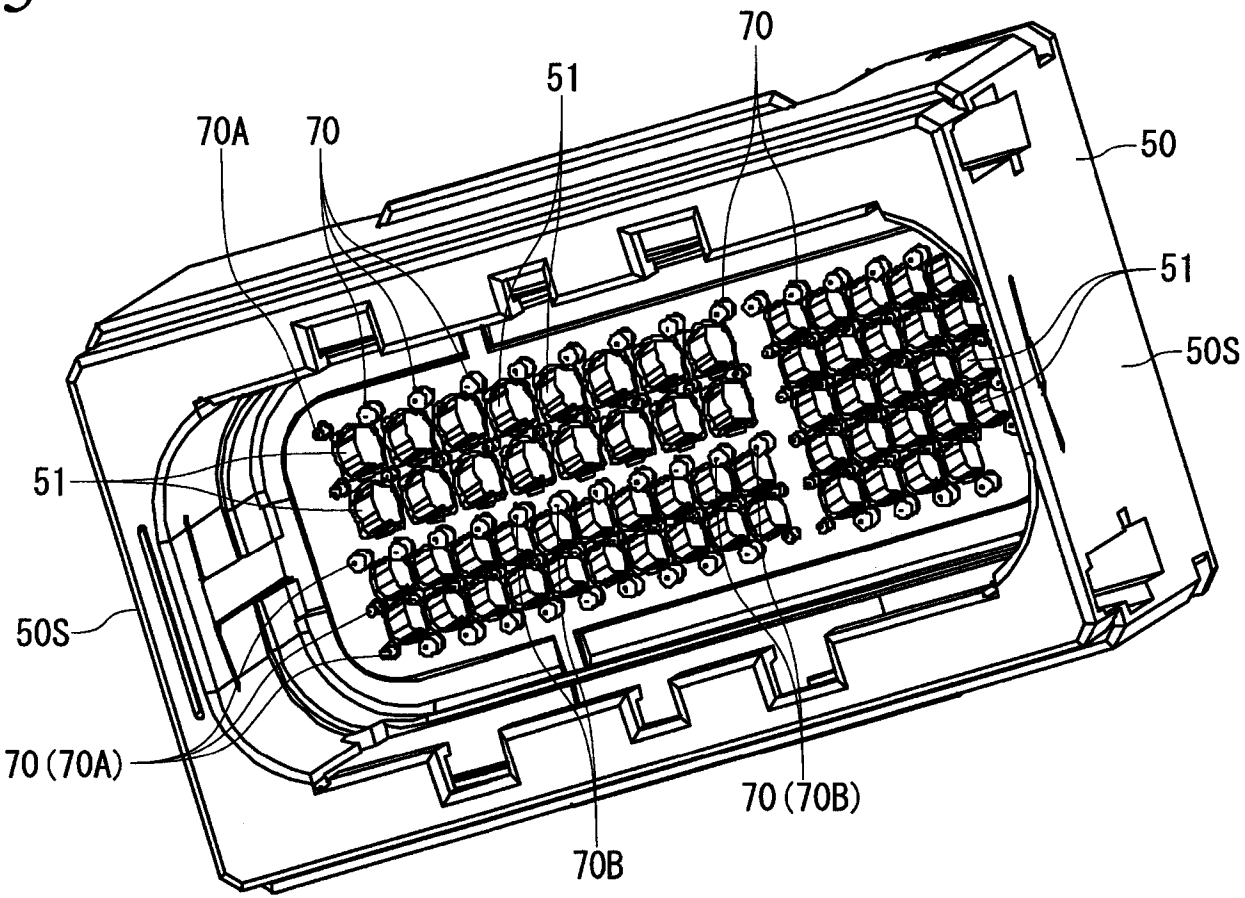
FIG. 5 is a perspective view of an outer housing of the water-proof connector according to the invention.

As shown in FIG. 5, in the outer housing 50 configured as described above, a plurality of boss pins 70 are disposed along an outer peripheral part of a region in which the electrical wire insertion passageways 51 are formed. The plurality of boss pins 70 are disposed at intervals along the outer peripheral part of the region in which the electrical wire insertion passageways 51 are formed. In addition, the boss pins 70 may be disposed in the region in which the electrical wire insertion passageways 51 are formed.

Figure 6:
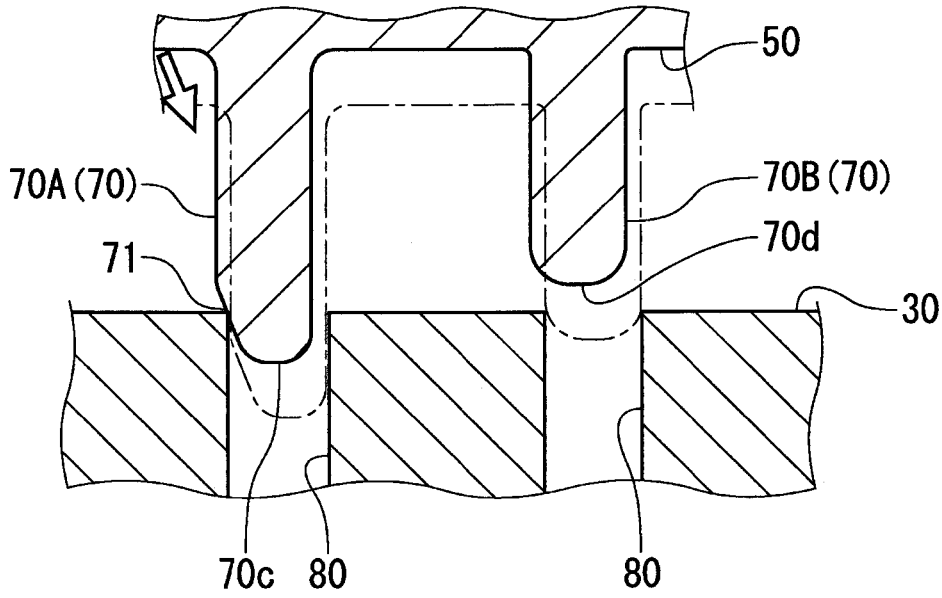
FIG. 6 is a cross-sectional view of boss pins formed in the outer housing according to the invention.
Figure 7:
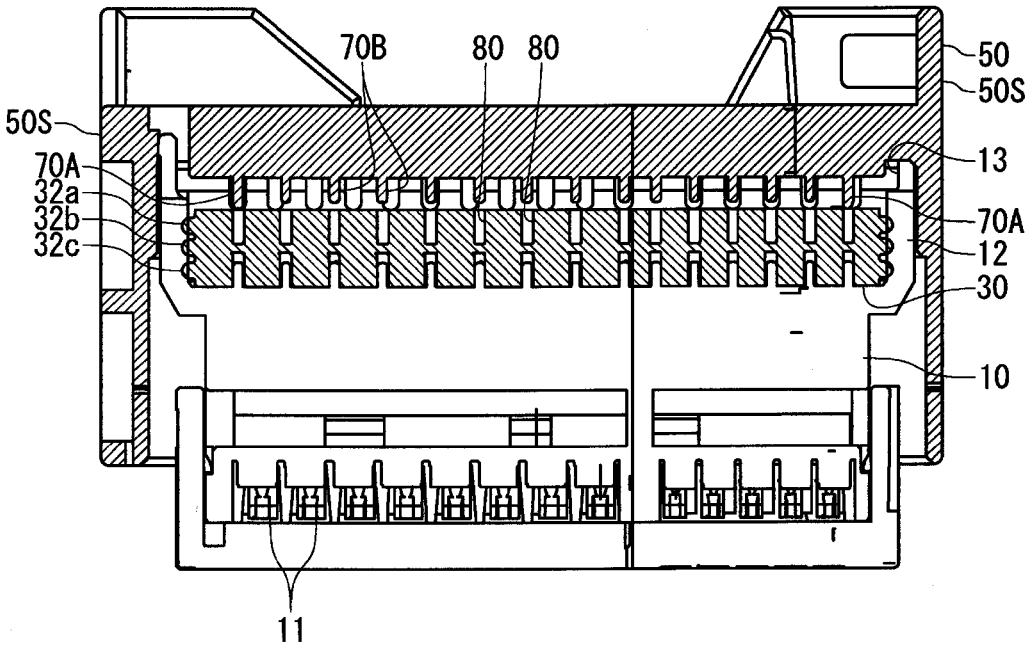
FIG. 7 is a cross-sectional view of the assembled water-proof connector.

As shown in FIGS. 5 to 7, of the plurality of boss pins 70 formed in the outer housing 50, boss pins 70A disposed along the outer peripheral part of the region in which the electrical wire insertion passageways 51 are formed, in particular, along a shorter side 50S of the outer housing 50, differ from boss pins 70B disposed in the other regions in that tip end parts 70*c* are tapered so that the diameter gradually decreases toward the tip end. As shown in FIG. 6, the tip end part 70*c* may have a tapered surface 71 only in the portion facing outward from the region in which the electrical wire insertion passageways 51 are formed. A tip end part 70*d* of the boss pin 70B may have a round shape, for example.

The length of protrusion of the boss pins 70A from the outer housing 50 is greater than the length of protrusion of the boss pins 70B.

Figure 1:
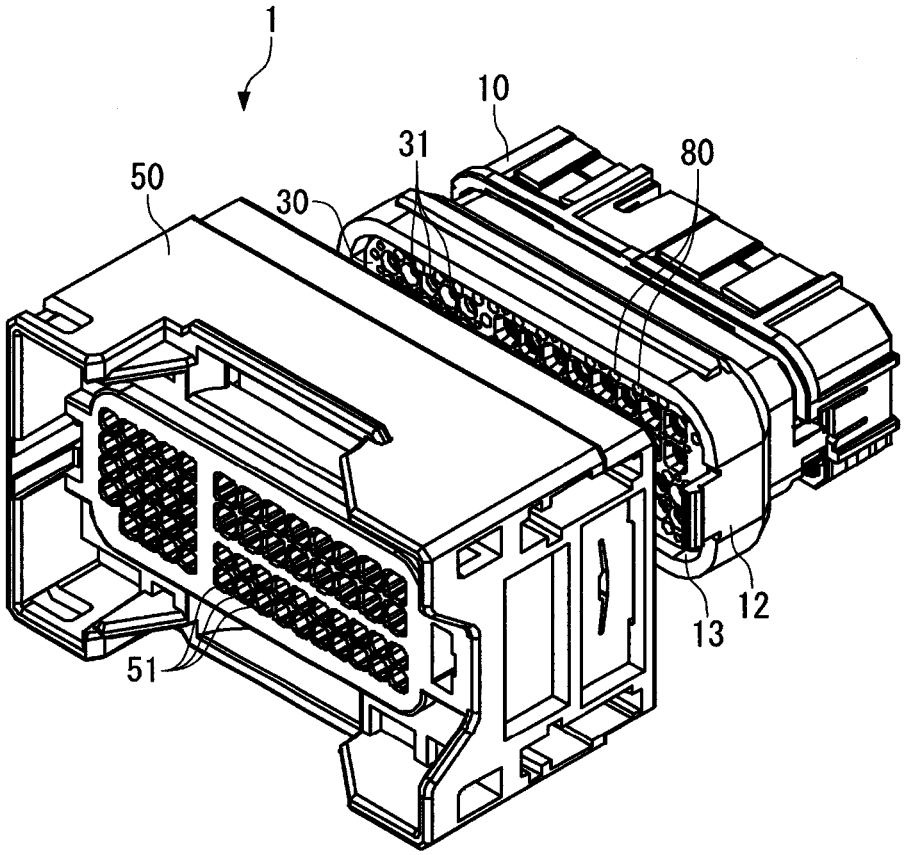
FIG. 1 is an exploded perspective view of a water-proof connector according to the invention.

As shown in FIG. 1, the wire seal 30 has pin insertion passageways 80 at positions corresponding to the boss pins 70 of the outer housing 50.

With the construction described above, the boss pins 70A of the boss pins 70 that are disposed along the outer periphery of the region in which the electrical wire insertion passageways 51 are formed have the tapered tip end parts 70*c*. Therefore, in fitting of the wire seal 30 mounted in the inner housing 10 into the outer housing 50, even if the boss pins 70A are misaligned with the pin insertion passageways 80 when the tip end parts 70*c* of the boss pins 70A come into contact with the pin insertion passageways 80, the boss pins 70A can be easily guided into the pin insertion passageways 80.

In addition, since the boss pins 70A of the boss pins 70 that are disposed in the outer peripheral part of the region in which the electrical wire insertion passageways 51 are formed have a greater length of protrusion, when the wire seal 30 is fitted into the outer housing 50, the tip end parts 70*c* of the boss pins 70A disposed in the outer peripheral part come into contact with the pin insertion passageways 80 earlier than the boss pins 70B disposed in that region. As a result, even if the boss pins 70A and 70B are misaligned with the pin insertion passageways 80, the boss pins 70A and 70B can be easily guided into the pin insertion passageways 80.

As described above, the wire seal 30 can be reliably assembled into the outer housing 50 at a proper position by smoothly and reliably fitting the boss pins 70 into the pin insertion passageways 80. As a result, the water-proof connector 1 can be smoothly assembled and properly carry out its function as a connector.

Although particular configurations of components of the water-proof connector 1 have been described in the embodiment described above, the configurations of the inner housing 10 and the outer housing 50, for example, are intended only for illustrative purposes, and the present invention can be applied to any water-proof connector incorporating the wire seal 30.

The components described in the above embodiment can be appropriately omitted or modified without departing from the spirit of the present invention.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A water-proof connector comprising:

an inner housing having a plurality of contact receiving passageways;

a wire seal fit with the inner housing and having a plurality of contact insertion passageways disposed along positions corresponding to the plurality of contact receiving passageways;

an outer housing having a recess receiving the inner housing with the wire seal interposed between the outer housing and the inner housing; a plurality of electrical wire insertion passageways disposed at positions corresponding to the plurality of contact receiving passageways; and a plurality of first boss pins disposed along an outer peripheral part of a region in which the plurality of electrical wire insertion passageways are formed and having tip end parts with an asymmetrically tapered surface in a portion facing outward from the region in which the plurality of electrical wire insertion passageways are formed; and a plurality of pin insertion passageways disposed along the wire seal surface facing the outer housing and into which the plurality of first boss pins are inserted.

2. The water-proof connector according to claim 1, wherein the outer housing further includes a plurality of second boss pins disposed along other regions than the outer peripheral part of the region in which the plurality of electrical wire insertion passageways are formed.

3. The water-proof connector according to claim 2, wherein the plurality of second boss pins include a tip end part having round shape.

4. The water-proof connector according to claim 2, wherein the plurality of first boss pins are longer than the plurality of second boss pins.

5. The water-proof connector according to claim 1, wherein the inner housing includes a frontward extending peripheral wall formed along a circumference of a front end of the inner housing facing the outer housing.

6. The water-proof connector according to claim 5, wherein an interior of the peripheral wall forms a seal housing recess for housing the wire seal.

7. The water-proof connector according to claim 6, wherein the wire seal has a substantially plate shape and is configured to be housed in the seal housing recess.

8. The water-proof connector according to claim 1, further comprising a plurality of ridges formed on an inner periphery of each contact insertion passageway that are in close contact with an outer peripheral surface of an electrical wire.

9. A water-proof connector comprising:

an inner housing having a plurality of contact receiving passageways;

a wire seal fit with the inner housing and having a plurality of contact insertion passageways disposed along positions corresponding to the plurality of contact receiving passageways;

an outer housing having a recess receiving the inner housing with the wire seal interposed between the outer housing and the inner housing;

a plurality of electrical wire insertion passageways disposed at positions corresponding to the plurality of contact receiving passageways;

a plurality of first boss pins disposed along an outer peripheral part of a region in which the plurality of electrical wire insertion passageways are formed and having tip end parts with an asymmetrically tapered surface in a portion facing outward from the region in which the plurality of electrical wire insertion passageways are formed;

a plurality of second boss pins disposed along other regions than the outer peripheral part of the region in which the plurality of electrical wire insertion passageways are formed, and a plurality of pin insertion passageways disposed along the wire seal surface facing the outer housing and into which the plurality of first boss pins are inserted.

10. The water-proof connector according to claim 9, wherein the plurality of first boss pins are longer than the plurality of second boss pins.

11. The water-proof connector according to claim 9, wherein the plurality of second boss pins include a tip end part having round shape.

12. The water-proof connector according to claim 9, wherein the inner housing includes a frontward extending peripheral wall formed along a circumference of a front end of the inner housing facing the outer housing.

13. The water-proof connector according to claim 12, wherein an interior of the peripheral wall forms a seal housing recess for housing the wire seal.

14. The water-proof connector according to claim 13, wherein the wire seal has a substantially plate shape and is configured to be housed in the seal housing recess.

15. The water-proof connector according to claim 9, further comprising a plurality of ridges formed on an inner periphery of each contact insertion passageway that are in close contact with an outer peripheral surface of an electrical wire.

16. A water-proof connector comprising:

an inner housing having a plurality of contact receiving passageways;

a wire seal fit with the inner housing and having a plurality of contact insertion passageways disposed along positions corresponding to the plurality of contact receiving passageways;

an outer housing having a recess receiving the inner housing with the wire seal interposed between the outer housing and the inner housing;

a plurality of electrical wire insertion passageways disposed at positions corresponding to the plurality of contact receiving passageways;

a plurality of first boss pins disposed along an outer peripheral part of a region in which the plurality of electrical wire insertion passageways are formed and having tip end parts with an asymmetrically tapered surface in a portion facing outward from the region in which the plurality of electrical wire insertion passageways are formed;

a plurality of second boss pins disposed along other regions than the outer peripheral part of the region in which the plurality of electrical wire insertion passageways are formed, wherein the plurality of first boss pins are longer than the plurality of second boss pins; and a plurality of pin insertion passageways disposed along the wire seal surface facing the outer housing and into which the plurality of first boss pins are inserted.

17. The water-proof connector according to claim 16, wherein the plurality of second boss pins include a tip end part having round shape.

18. The water-proof connector according to claim 16, wherein the inner housing includes a frontward extending peripheral wall formed along a circumference of a front end of the inner housing facing the outer housing.

19. The water-proof connector according to claim 18, wherein an interior of the peripheral wall forms a seal housing recess for housing the wire seal.

20. The water-proof connector according to claim 19, wherein the wire seal has a substantially plate shape and is configured to be housed in the seal housing recess.

* * * * *